US005643441A

United States Patent [19]

Timken et al.

[11] Patent Number: 5,643,441

[45] Date of Patent: *Jul. 1, 1997

[54] NAPHTHA UPGRADING PROCESS

[75] Inventors: Hye Kyung C. Timken, Woodbury, N.J.; Sherri L. Riedinger, New Castle, Del.

[73] Assignee: Mobil Oil Corporation, Fairfax, Va.

[ * ] Notice: The term of this patent shall not extend beyond the expiration date of Pat. No. 5,346,609.

[21] Appl. No.: 427,512

[22] Filed: Apr. 24, 1995

Related U.S. Application Data

[63] Continuation-in-part of Ser. No. 133,403, Oct. 8, 1993, Pat. No. 5,411,658, and Ser. No. 303,908, Sep. 24, 1994, which is a continuation-in-part of Ser. No. 133,403, which is a continuation-in-part of Ser. No. 891,124, Jun. 1, 1992, Pat. No. 5,413,696, which is a continuation-in-part of Ser. No. 850,106, Mar. 12, 1992, Pat. No. 5,409,596, which is a continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/212; 208/213

[58] Field of Search ..... 208/89

[56] References Cited

U.S. PATENT DOCUMENTS

| | | | |
|---|---|---|---|
| 3,759,821 | 9/1973 | Brennan et al. | 208/93 |
| 3,957,625 | 5/1976 | Orkin | 208/211 |
| 4,419,220 | 12/1983 | La Pierre et al. | 208/111 |
| 4,827,076 | 5/1989 | Kokayeff et al. | 208/212 |
| 4,911,823 | 3/1990 | Chen | 208/67 |
| 5,346,609 | 9/1994 | Fletcher et al. | 208/89 |
| 5,352,354 | 10/1994 | Fletcher et al. | 208/89 |
| 5,401,389 | 3/1995 | Mazzone et al. | 208/89 |
| 5,409,596 | 4/1995 | Fletcher et al. | 208/89 |
| 5,411,658 | 5/1995 | Chawla et al. | 208/89 |
| 5,413,696 | 5/1995 | Fletcher et al. | 208/89 |

*Primary Examiner*—Helane Myers
*Attorney, Agent, or Firm*—R. B. Furr, Jr.

[57] ABSTRACT

Low sulfur gasoline of relatively high octane number is produced from a thermally cracked sulfur-containing naphtha such as coker naphtha, by hydrodesulfurization followed by treatment over an acidic catalyst, preferably a zeolite such as ZSM-5 or zeolite beta with a hydrogenation component, preferably molybdenum. The treatment over the acidic catalyst in the second step restores the octane loss which takes place as a result of the hydrogenative treatment and results in a low sulfur gasoline product

10 Claims, 3 Drawing Sheets

NAPHTHA UPGRADING PROCESS

CROSS REFERENCE TO RELATED APPLICATIONS

This application is a continuation-in-part of our prior application Ser. No. 08/133,403, filed 8 Oct. 1993, (now U.S. Pat. No. 5,411,658), which is a continuation-in-part of prior application Ser. No. 07/891,124, filed 1 Jun. 1992 (now U.S. Pat. No. 5,413,696) which, in turn, is a continuation-in-part of prior application Ser. No. 07/850,106, filed 12 Mar. 1992 (now U.S. Pat. No. 5,409,596), which, in turn, is a continuation-in-part of prior application Ser. No. 07/745,311, filed 15 Aug. 1991, now U.S. Pat. No. 5,346,609.

This application is also a continuation-in-part of prior application Ser. No. 08/303,908, filed 24 Sep. 1994, which is a continuation-in-part of Ser. No. 08/133,403, filed 8 Oct. 1993 (now U.S. Pat. No. 5,411,658), which in turn, is a continuation-in-part of prior application Ser. No. 07/891,124, referred to above.

The contents of Ser. Nos. 08/133,403; 07/891,124; 07/850,106 and 07/745,311 are incorporated in this application by reference.

FIELD OF THE INVENTION

This invention relates to a process for the upgrading of hydrocarbon streams. It more particularly refers to a process for upgrading naphtha boiling range petroleum fractions containing substantial proportions of sulfur impurities.

BACKGROUND OF THE INVENTION

Heavy petroleum fractions, such as vacuum gas oil, or even resids such as atmospheric resid, may be catalytically cracked to lighter and more valuable products, especially gasoline. Catalytically cracked gasoline forms a major part of the gasoline product pool in the United States. It is conventional to recover the product of catalytic cracking and to fractionate the cracking products into various fractions such as light gases; naphtha, including light and heavy gasoline; distillate fractions, such as heating oil and Diesel fuel; lube oil base fractions; and heavier fractions.

Where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines. In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina.

In the hydrotreating of petroleum fractions, particularly naphthas, and most particularly heavy cracked gasoline, the molecules containing the sulfur atoms are mildly hydrocracked so as to release their sulfur, usually as hydrogen sulfide.

After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Naphthas, including light and full range virgin naphthas, may be subjected to catalytically reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute substantial volume to the gasoline pool, but they do not generally contribute significantly to higher octane values without reforming.

In U.S. Pat. No. 5,346,609 U.S. Pat. No. 5,409,596 and (Ser. No. 08/850,106) we have described a process for effectively desulfurizing catalytically cracked naphthas while maintaining a high octane number. Briefly, the process comprises an initial hydrodesulfurization step which reduces the sulfur to an acceptable level, although at the expense of octane which is restored in a subsequent step by treatment over an acidic catalyst such as one based on ZSM-5, as described in U.S. Pat. No. 5,346,609 and U.S. Pat. No. 5,490,596 (Ser. No. 08/850,106), zeolite beta as described in Ser. No. 07/891,124 (now U.S. Pat. No. 5,413,696) or MCM-22 as described in U.S. Pat. No. 5,352,354. The use of a molybdenum-containing ZSM-5 catalyst is described in Ser. Nos. 08/133,403 and 08/133,942. Reference is made to these disclosures for a detailed description of the problems of cracked naphtha desulfurization as well as of the octane-retention desulfurization processes described in those patents.

Other highly unsaturated fractions boiling in the gasoline boiling range, which are produced in some refineries or petrochemical plants, include pyrolysis gasoline and coker naphtha. Coker naphtha is a fraction which is produced by a coking process, either delayed coking, fluid coking or Contact coking, all of which are well-known processes in the petroleum refining industry. See, for example, Modern Petroleum Technology, Hobson and Pohl (Ed.), Applied Science Publ. Ltd., 1973, ISBN 085334 487 6, pages 283–288, and Advances in Petroleum Chemistry and Refining, Kobe and McKetta, Interscience, N.Y. 1959, Vol. II, pages 357–433, to which reference is made for a description of these processes.

Coker naphtha, being produced by the coking of residual chargestocks, has a high sulfur content, typically at least 1,000 ppmw (0.1 percent by weight) or even higher, for example 5,000 to 10,000 ppmw (0.5 to 1.0 percent) and a low octane number, typically no higher than about 70. It is also unstable and tends to form gums by polymerization of diolefins and other unsaturated species which are present in these thermally cracked products. Although the content of unsaturates is high, with bromine numbers typically in the range of 50 to 80, there is no positive contribution to octane from the unsaturates as they are low octane components. The combination of high sulfur content and low octane makes coker naphtha an unpromising candidate for treatment by the process described in the patents referred to above.

We have found, however, that the use of molybdenum-containing catalysts is favorable for the treatment of coker naphthas, using either medium pore size or large pore size acidic components in the catalysts, especially ZSM-5 and zeolite beta.

SUMMARY OF THE INVENTION

According to the present invention, the process for catalytically desulfurizing thermally cracked fractions in the gasoline boiling range, especially coker naphthas, enables the sulfur to be reduced to acceptable levels for blending into the refinery gasoline pool. Octane may be retained or even, in favorable cases, improved.

According to the present invention, a sulfur-containing thermally cracked naphtha such as coker naphtha is hydrotreated, in a first stage, under conditions which remove at least a substantial proportion of the sulfur. The hydrotreated intermediate product is then treated, in a second stage, by contact with a catalyst of acidic functionality under conditions which convert the hydrotreated intermediate product fraction to a fraction in the gasoline boiling range of higher octane value.

DETAILED DESCRIPTION

Feed

Figure 1:
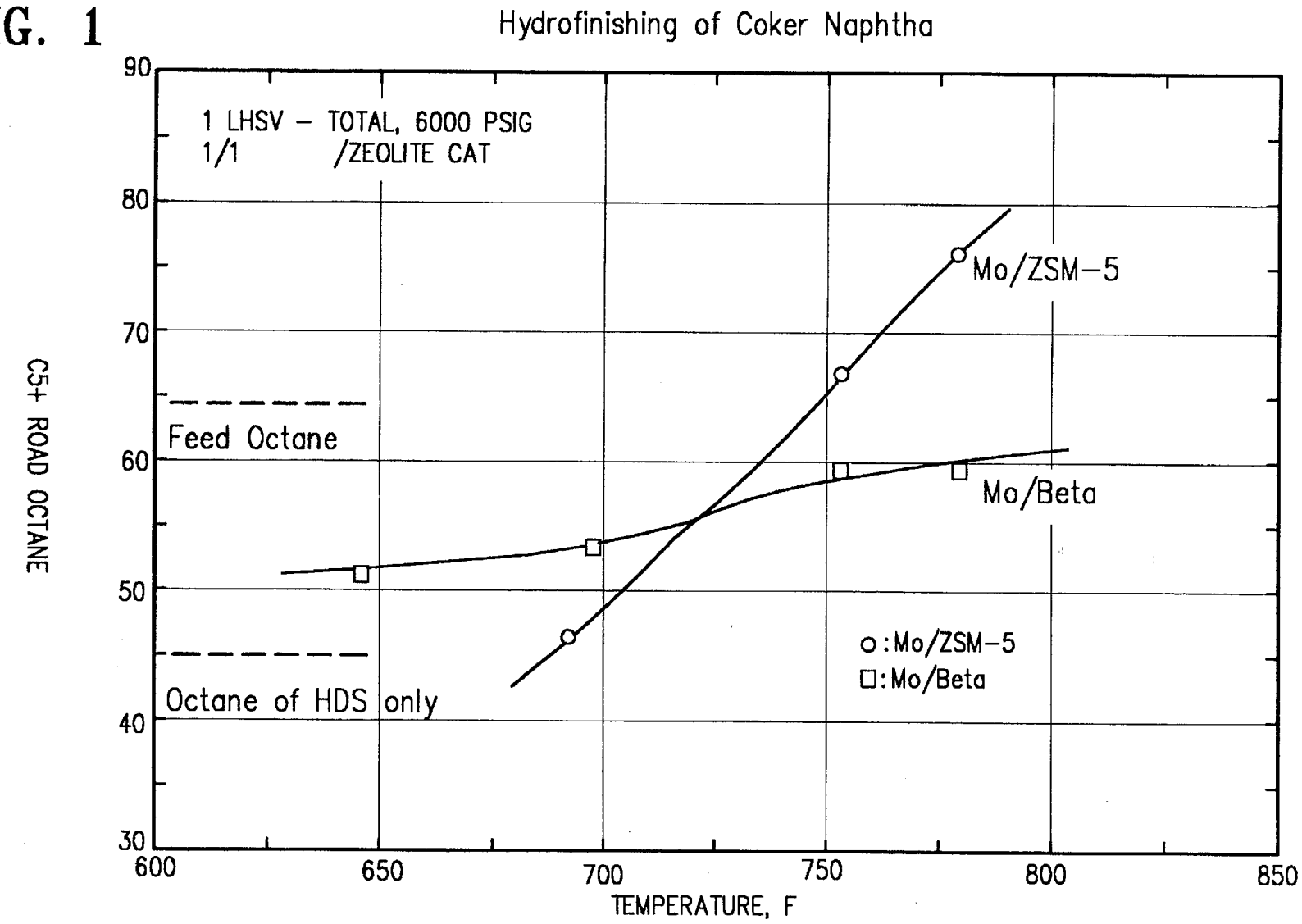
FIGS. 1 to 3 are a series of plots of the octane and yield from the treatment of coker naphtha using ZSM-5 and zeolite beta catalysts, as described in the Examples.

The feed to the process comprises a sulfur-containing thermally cracked petroleum fraction which boils in the gasoline boiling range. The preferred feed of this type is coker naphtha although other thermally cracked feeds such as pyrolysis gasoline may also be used. Coker naphtha is obtained by thermal cracking of a residual feed in a coker. As mentioned above, coking processes are well-established in the petroleum refining industry and are used for converting residual chargestocks into higher value liquid products. The delayed coking process is in widespread use in the United States as noted above; variants of the typical delayed coking processes are described in U.S. Pat. Nos. 5,200,061; 5,258,115; 4,853,106; 4,661,241 and 4,404,092.

Coker naphthas may be light naphthas typically having a boiling range of about $C_6$ to 330° F., full range naphthas typically having a boiling range of about $C_5$ to 420° F., heavier naphtha fractions boiling in the range of about 260° to 412° F., or heavy gasoline fractions boiling at, or at least within, the range of about 330° to 500° F., preferably about 330° to 412° F., depending on the mode of operation of the coker fractionator (combination tower) and refinery requirements. The present process may be operated with the entire naphtha fraction obtained from the coker or, alternatively, with part of it.

The sulfur content of the coker naphtha will depend on the sulfur content of the feed to the coker as well as on the boiling range of the selected fraction used as the feed in the process. Lighter fractions, for example, will tend to have lower sulfur contents than the higher boiling fractions. As a practical matter, the sulfur content will normally exceed 1,000 ppmw and usually will be in excess of 2000 ppmw and in most cases in excess of about 5000 ppmw. The nitrogen content is not as characteristic of the feed as the sulfur content and is preferably not greater than about 50 ppmw although higher nitrogen levels typically up to about 150 ppmw may be found in certain naphthas. As described above, the coker naphthas are unsaturated fractions containing significant amounts of diolefins as a result of the thermal cracking.

Process Configuration

The process is carried out in the manner described in U.S. Pat. No. 5,346,609, as are the conditions of operation and the type of catalysts which may be used, which reference is made for details of them. Briefly, the naphtha feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content than the feed.

This hydrotreated intermediate product which also boils in the gasoline boiling range (and usually has a boiling range which is not substantially higher than the boiling range of the feed), is then treated by contact with an acidic catalyst under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable or even higher octane rating as the result of the second stage treatment.

The catalyst used in the second stage of the process has a significant degree of acid activity, and for this purpose the most preferred materials are the crystalline refractory solids having an intermediate effective pore size and the topology of a zeolitic behaving material, which, in the aluminosilicate form, has a constraint index of about 2 to 12. A metal component having a mild degree of hydrogenation activity is preferably used in this catalyst.

Hydrotreating

The temperature of the hydrotreating step is suitably from about 500° to 850° F. (about 260° to 454° C.), preferably about 500° to 750° F. (about 260° to 400° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization of the coker naphtha feed but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction.

Since the feeds are readily desulfurized, low to moderate pressures may be used, typically from about 50 to 1500 psig (about 445 to 10443 kPa), preferably about 300 to 1000 psig (about 2170 to 7,000 Kpa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.1.1^{-1}$.), usually about 1000 to 3000 SCF/B (about 180 to 445 $n.1.1^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate, as described in U.S. Pat. No. 5,346,609. The Group VI metal is preferably molybdenum or tungsten and the Group VIII metal usually nickel or cobalt.

Octane Restoration—Second Step Processing

After the hydrotreating step, the hydrotreated intermediate product is passed to the second step of the process in which cracking takes place in the presence of the acidic functioning catalyst. The effluent from the hydrotreating step may be subjected to an interstage separation in order to remove the inorganic sulfur and nitrogen as hydrogen sulfide and ammonia as well as light ends but this is not necessary and, in fact, it has been found preferable to cascade the first stage product directly into the second step to utilize the exotherm from the hydrotreatment to supply enthalpy for the second stage treatment.

The second step of the process is characterized by a controlled degree of shape-selective cracking of the desulfurized, hydrotreated effluent from the first step to provide the desired contribution to product octane. The reactions which take place during the second step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. The mechanism for octane improvement with Mo/ZSM-5 and Mo/beta also seems to include dehydrocyclization/aromatization of paraffins to alkylbenzenes. Back-end conversion (particularly with Mo/beta) also improves the octane. In favorable cases, the original octane rating of the feed may be completely restored or perhaps even exceeded. Since the volume of the second stage product will typically be comparable to that of the original feed or even exceed it, the number of octane barrels (octane rating×volume) of the final, desulfurized product may exceed the octane barrels of the feed.

The conditions used in the second step are those which are appropriate to produce this controlled degree of cracking. Typically, the temperature of the second step will be about 500° to 850° F. (about 260° to 455° C.), preferably about 600° to 800° F. (about 315° to 425° C.). The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 Kpa), preferably about 300 to 1000 psig (about 2170 to 7000 Kpa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.1.1^{-1}$.), preferably about 100 to 3000 SCF/Bbl (about 18 to 445 $n.1.1^{-}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$–) during the second stage is held to a minimum but with thermally cracked naphtha feeds, a relatively high temperature may be required to give the desired increment to product octane.

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials which are exemplified by those acid acting materials having the topology of intermediate pore size aluminosilicate zeolites. These zeolitic catalytic materials are exemplified by those which, in their aluminosilicate form would have a Constraint Index between about 2 and 12, such as ZSM-5, ZSM-11, ZSM-12, ZSM-21, ZSM-22, ZSM-23, ZSM-35, ZSM-48, ZSM-50 or MCM-22, as described in U.S. Pat. No. 5,346,609. Other catalytic materials having the appropriate acidic functionality may, however, be employed. A particular class of catalytic materials which may be used are, for example, the large pore size zeolite materials which have a Constraint Index of up to about 2 (in the aluminosilicate form). Zeolites of this type include mordenite, zeolite beta, faujasites such as zeolite Y and ZSM-4, with zeolite beta being preferred for the treatment of coker naphthas.

It is desirable to include a hydrogenation component in this catalyst, as described in Ser. No. 08/133,403, to which reference is made for details of molybdenum-containing acidic catalysts. Molybdenum is the preferred hydrogenation component, producing good results with both ZSM-5 and zeolite beta, as shown in the Examples below. With coker naphtha, Mo/ZSM-5 exhibits good activity for octane recovery. Product octane can be increased as high as 75 road by raising the reactor temperature. However, the yield-loss per octane is quite high. Mo/beta has lower activity for octane recovery than Mo/ZSM-5 but has a significant advantage in higher gasoline yield.

EXAMPLES

The following examples illustrate the operation of the present process. In these examples, parts and percentages are by weight unless they are expressly stated to be on some other basis. Temperatures are in ° F. and pressures in psig, unless expressly stated to be on some other basis.

EXAMPLE 1

Preparation of Mo/ZSM-5 Catalyst

A physical mixture of 80 parts ZSM-5 and 20 parts pseudoboehmite alumina powder (by weight, 100% solids basis) was mulled to form an uniform mixture and formed into 1/16 inch (1.6 mm.) cylindrical shape extrudates using a standard augur extruder. The extrudates were dried on a belt drier at 127° C. and then nitrogen calcined at 48C° C. for 3 hours followed by a 6 hour air calcination at 538° C. The catalyst was then steamed at 100% steam at 480° C. for approximately 4 hours.

The steamed extrudates were impregnated with 4 wt % Mo and 2 wt % P using an incipient wetness method with a solution of ammonium heptamolybdate and phosphoric acid. The impregnated extrudates were then dried at 120° C. overnight and calcined at 500° C. for 3 hours. The properties of the final catalyst are listed in Table 1 below.

EXAMPLE 2

Preparation of a Mo/zeolite beta Catalyst

A physical mixture of 65 parts zeolite beta and 35 parts pseudoboehmite alumina powder (parts by weight, 100% solids basis) was mulled to form an uniform mixture and formed into 1/16 inch (1.6 mm) cylindrical shape extrudates using a standard augur extruder. The extrudates were dried on a belt drier at 127° C. and then nitrogen calcined at 480° C. for 3 hours followed by a 6 hour air calcination at 538° C. The catalyst was then steamed at 100% steam at 480° C. for 4 hours.

The steamed extrudates were impregnated with 4 wt % Mo and 2 wt % P using an incipient wetness method with ammonium heptamolybdate and phosphoric acid solution. The impregnated extrudates were then dried at 120° C. overnight and calcined at 500° C. for 3 hours. The properties of the final catalyst are listed in Table 1.

The properties of the hydrotreating catalyst are also reported in Table 1 below.

TABLE 1

Physical Properties of Catalysts

| | CoMo Rxr Top Cat. | Mo/ZSM-5 Rxr Btm. Cat. | Mo/Beta Rxr Btm. Cat. |
|---|---|---|---|
| Zeolite | — | ZSM-5 | Beta |
| Zeolite, wt. pct. | — | 80 | 65 |
| Alpha | — | 132* | 141* |
| Surface Area, $m_2g$-1 | 260 | 289 | 415 |
| n-Hexane sorption, wt. % | — | 10.4 | — |
| cy-Hexane sorption, wt. % | — | — | 14.9 |
| Co, wt. pct. | 3.4 | NA | NA |
| Mo, wt. pct. | 10.2 | 3.6 | 3.8 |
| P, wt. pct. | — | 1.7 | 1.7 |

Before Mo impregnation
NA Not applicable

EXAMPLE 3

Upgrading of Coker Naphtha with Mo/ZSM-5

This example illustrates the coker naphtha upgrading performance of a Mo/ZSM-5 catalyst (Example 1) for producing low sulfur gasoline. The feedstock (Coker Naphtha I) properties are shown in Table 2 below, together with those of another coker naphtha used in Example 4.

TABLE 2

Properties of Coker Naphtha Feed

| | Coker Naphtha I | Coker Naphtha II |
|---|---|---|
| General Properties | | |
| Nominal Boiling Range, °F. | 170–330 | 180–400 |
| Specific Gravity, g/cc | 0.742 | 0.772 |
| Total Sulfur, wt % | 0.7 | 0.6 |
| Nitrogen, ppm | 71 | 120 |
| Bromine Number | 72.0 | 61.9 |
| Research Octane | 68.0 | 60.0 |
| Motor Octane | 60.6 | 56.3 |
| Distillation, °F. (D2887) | | |
| IBP | 70 | 169 |
| 5% | 98 | 204 |
| 10% | 138 | 213 |
| 30% | 205 | 264 |
| 50% | 254 | 307 |
| 70% | 297 | 344 |
| 90% | 341 | 390 |
| 95% | 351 | 400 |
| EP | 413 | 441 |

The experiments were carried out in a fixed-bed pilot unit employing a commercial CoMo/Al203 hydrodesulfurization (HDS) catalyst and the Mo/ZSM-5 catalyst. Each catalyst was sized to 14/28 U.S. mesh and loaded in a reactor. The pilot unit was operated in a cascade mode where desulfurized effluent from the hydrotreating stage cascaded directly to the zeolite-containing catalyst without removal of ammonia, hydrogen sulfide, and light hydrocarbon gases at the inter-stage. The conditions employed for the experiments included temperatures from 500°–800° F. (260° C.–427° C.), 1.0 LHSV (based on fresh feed relative to total catalysts), 3000 scf/bbl (535 n.1.1.$^{-1}$) of once-through hydrogen circulation, and an inlet pressure of 600 psig (4240 Kpa abs). The ratio of hydrotreating catalyst to cracking catalyst was 1/1 vol/vol.

Table 3 summarizes the results. The octane recovery and gasoline volume yield are plotted in FIGS. 1 and 2 as a function of temperature.

TABLE 3

Upgrading of Coker Naphtha with Mo/ZSM-5

| | Naphtha Feed | CoMo HDS/ Mo/ZSM-5 | | |
|---|---|---|---|---|
| Stage 1 Temp., °F. | — | 705 | 701 | 702 |
| Stage 2 Temp., °F. | — | 693 | 753 | 778 |
| Days on Stream | — | 5.0 | 8.2 | 9.2 |
| Product Analyses | | | | |
| Sulfur, wt % | 0.7 | 0.020* | 0.006* | 0.012* |
| Nitrogen, ppmw | 71 | <1* | <1* | 7* |
| C5+ Research Octane | 68.0 | 45.4 | 68.3 | 77.5 |
| C5+ Motor Octane | 60.6 | 46.8 | 66.3 | 74.7 |
| Olefin Yield, wt % | | | | |
| C2=+C3=+C4= | — | 0.2 | 1.4 | 1.2 |
| C5=+ | 39.9 | 0.2 | 0.6 | 0.4 |
| C5+ Gasoline Yields | | | | |
| vol % | 100 | 100.3 | 79.3 | 68.8 |
| wt % | 100 | 98.8 | 78.1 | 68.4 |
| Process Yields, wt % | | | | |
| C1 + C2 | — | 0.1 | 1.1 | 2.2 |
| C3 | — | 0.4 | 9.0 | 13.8 |

TABLE 3-continued

| Upgrading of Coker Naphtha with Mo/ZSM-5 | | | | |
|---|---|---|---|---|
| | Naphtha Feed | CoMo HDS/ Mo/ZSM-5 | | |
| C4 | — | 1.0 | 12.4 | 16.4 |
| C5-300° F. | 71.3 | 71.4 | 61.7 | 52.0 |
| 300° F.+ | 28.7 | 27.4 | 16.4 | 16.4 |
| Conversion, % | | | | |
| 300° F.+ | — | 11 | 47 | 47 |
| Hydrogen Consumption (scf/bbl) | — | 400 | 600 | 800 |

*: Measured with a product stripped to remove H2S
Conditions: 600 psig, 3000 scf/bbl H2, 1.0 overall LHSV The data contained in Table 3 and FIG. 1 clearly demonstrate the improvement of coker naphtha product quality with this process. The HDS and Mo/ZSM-5 catalyst combination produces gasoline with very low sulfur (<200 ppm) and nitrogen (<10 ppm). After hydrodesulfurization, the octane of the coker naphtha drops to about 45 road octane.

With Mo/ZSM-5, feed octane is easily recovered at about 750° F. reactor temperature. By increasing reactor temperatures, Mo/ZSM-5 can further increase the octane level of the coker naphtha. Desulfurized gasoline can be produced with 77 road octane at about 68% gasoline yield. The gasoline produced contains a very low level of olefins (<1%); this is an advantage for meeting olefin specifications for clean fuels.

EXAMPLE 4

Upgrading of Coker Naphtha with Mo/ZSM-5

This example illustrates the coker naphtha upgrading performance of a Mo/ZSM-5 catalyst (Example 1) with another coker naphtha feed. The feedstock (Coker Naphtha II) properties are shown in Table 2 above. The experiments were conducted at similar conditions to Example 3 with the exception of a lower hydrogen circulation (2000 scf/bbl once-through) and a slightly lower total pressure (535 psig).

Figure 3:
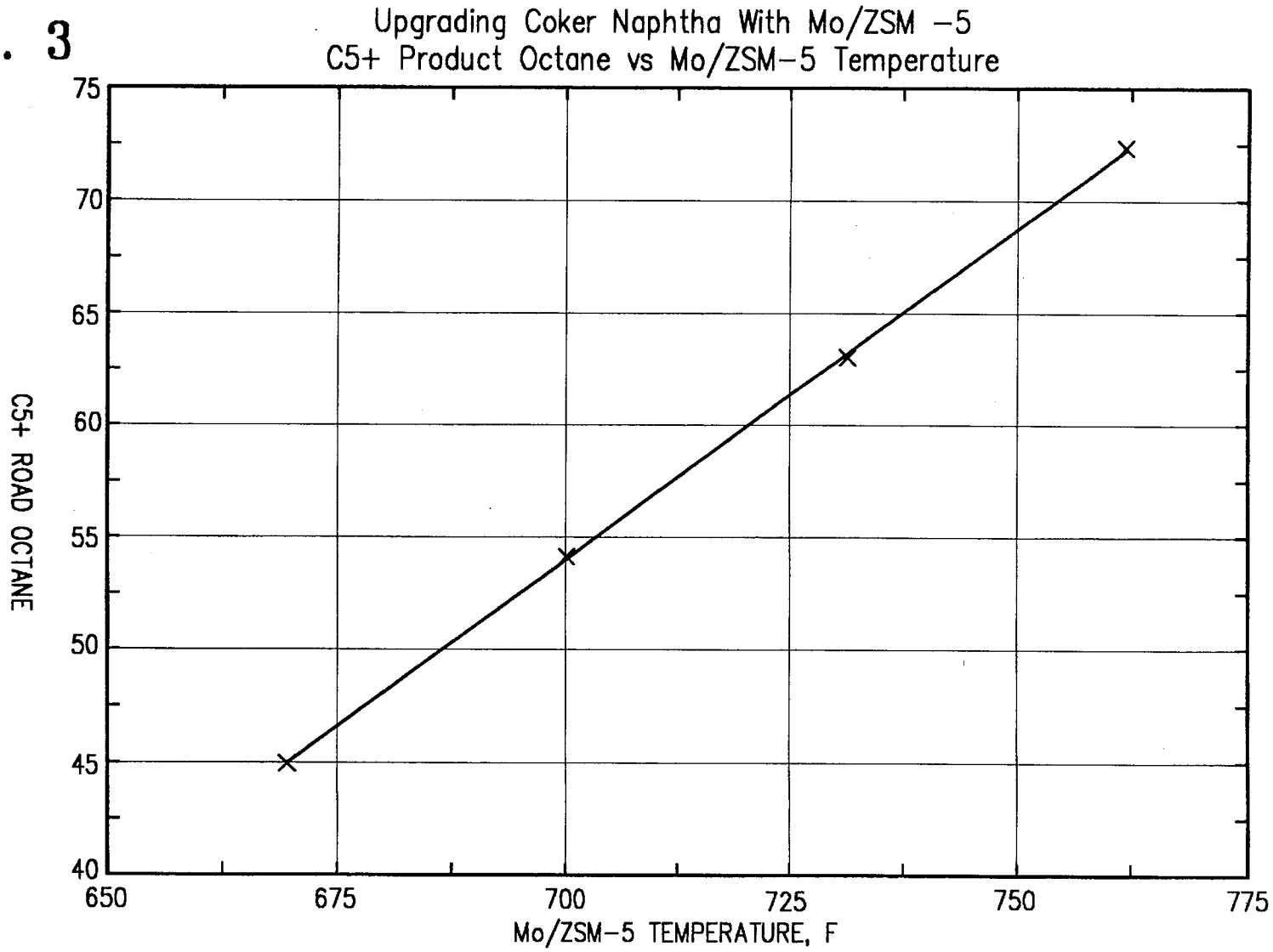

Table 4 summarizes the results. The octane recovery is plotted in FIG. 3 as a function of temperature.

TABLE 4

| Upgrading of Coker Naphtha with Mo/ZSM-5 | | | | | |
|---|---|---|---|---|---|
| | Naphtha Feed | CoMo HDS/ Mo/ZSM-5 | | | |
| Stage 1 Temp., oF | — | 624 | 702 | 699 | 700 |
| Stage 2 Temp., oF | — | 300 | 700 | 731 | 761 |
| Days on Stream | — | 181.3 | 168.2 | 176.8 | 173.3 |
| Product Analyses | | | | | |
| Sulfur, wt % | 0.6 | <0.002* | 0.006* | 0.002* | 0.014* |
| Nitrogen, ppmw | 120 | 5* | <5* | <5* | <5* |
| C5+ Research Octane | 60.0 | 37.1 | 51.9 | 62.7 | 73.1 |
| C5+ Motor Octane | 56.3 | 31.2 | 55.9 | 62.9 | 70.5 |
| Olefin Yield, wt % | | | | | |
| C2=+C3=+C4= | — | 0.0 | 0.6 | 1.0 | 0.8 |
| C5= | 34** | 0.1 | 0.6 | 0.6 | 0.4 |
| C5+ Gasoline Yields | | | | | |
| vol % | 100 | 101.1 | 93.2 | 85.6 | 75.4 |
| wt % | 100 | 99.7 | 93.0 | 84.3 | 74.6 |
| Process Yields, wt % | | | | | |
| C1 + C2 | — | 0.1 | 0.3 | 0.7 | 1.7 |
| C3 | — | 0.1 | 2.9 | 6.2 | 11.4 |
| C4 | — | 0.4 | 4.0 | 9.3 | 13.1 |
| C5-300oF | 53.2 | 50.0 | 53.8 | 51.2 | 45.1 |
| 300oF+ | 46.8 | 49.7 | 39.2 | 33.1 | 29.5 |
| Conversion, % | | | | | |
| 300oF+ | — | 7 | 26 | 38 | 45 |
| Hydrogen consumption (scf/bbl) | — | 400 | 400 | 550 | 625 |

*: Measured with product stripped to remove H2S
**: Estimated from bromine number
Conditions: 535 psig, 2000 scf/bbl H2, 1.0 overall LHSV The data contained in Table 4 and FIG. 3 also demonstrate the improvement of coker naphtha product quality with this process. Again, the gasoline produced is Very low in sulfur (<150 ppm), nitrogen (<5 ppm), and olefins (<1 wt %). After hydrodesulfurization, the octane of the coker naphtha drops to 34 road octane. Feed octane can be recovered with Mo/ZSM-5 at temperatures slightly above 700° F.; gasoline yield at these condition5 is around 90 vol % C5+. By increasing reactor temperatures, the octane of the desulfurized gasoline can be increased almost 40 road octane numbers to 72 road octane with 75 vol % gasoline yield.

EXAMPLE 5

Upgrading of Coker Naphtha with Mo/Beta

This example illustrates the coker naphtha upgrading performance of a Mo/beta catalyst (Example 2) for producing low sulfur gasoline. The same coker naphtha used in Example 3 (Coker Naphtha I) was used for these experiments. Table 5 summarizes the results. The octane recovery and gasoline volume yield are plotted in FIGS. 1 and 2 as a function of temperature.

TABLE 5

Upgrading of Coker Naphtha with Mo/Bet

| | Naphtha Feed | CoMo HDS/ Mo/Beta | | | |
|---|---|---|---|---|---|
| Stage 1 Temp., °F. | — | 651 | 702 | 707 | 706 |
| Stage 2 Temp., °F. | — | 647 | 698 | 753 | 776 |
| Days on Stream | — | 27.4 | 28.4 | 29.4 | 31.4 |
| Product Analyses | | | | | |
| Sulfur, wt % | 0.7 | 0.005* | 0.005* | 0.019* | 0.009* |
| Nitrogen, ppmw | 71 | 1* | 1* | 2* | <1* |
| C5+ Research Octane | 68.0 | 50.7 | 52.8 | 59.6 | 59.2 |
| C5+ Motor Octane | 60.6 | 51.9 | 54.4 | 59.3 | 59.7 |
| Olefin Yield, wt % | | | | | |
| C2=+C3=+C4= | — | 0.2 | 0.6 | 0.6 | 0.6 |
| C5=+ | 39.9 | 0.1 | 0.3 | 0.3 | 0.3 |
| C5+ Gasoline Yields | | | | | |
| vol % | 100 | 97.7 | 94.4 | 92.9 | 93.4 |
| wt % | 100 | 96.6 | 93.1 | 92.7 | 92.4 |
| Process Yields, wt % | | | | | |
| C1 + C2 | — | 0.1 | 0.2 | 0.2 | 0.2 |
| C3 | — | 0.6 | 1.3 | 1.3 | 1.4 |
| C4 | — | 2.9 | 5.6 | 5.7 | 6.1 |
| C5-300° F. | 71.3 | 71.4 | 71.3 | 69.7 | 71.9 |
| 300° F.+ | 28.7 | 25.2 | 21.8 | 23.0 | 20.5 |
| Conversion, % | | | | | |
| 300° F.+ | — | 19 | 30 | 26 | 34 |
| Hydrogen consumption (scf/bbl) | — | 400 | 500 | 300 | 400 |

Figure 2:
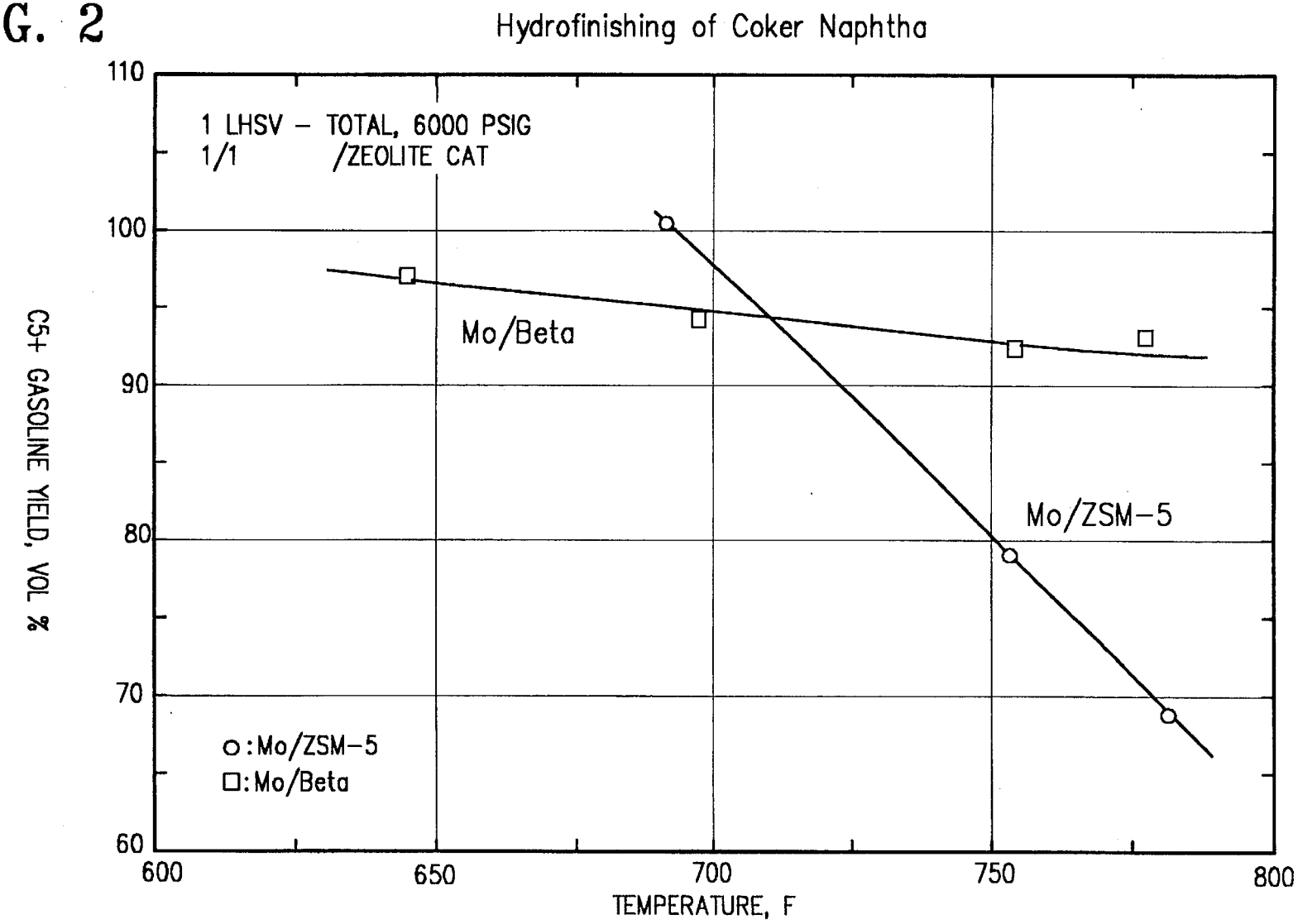

*: Measured with product stripped to remove H2S
Conditions: 600 psig, 3000 scf/bbl H2, 1.0 overall LHSV The data contained in Table 5 demonstrate that the HDS and Mo/beta catalyst combination also produces gasoline with very low sulfur (<200 ppm) and nitrogen (<10 ppm). After hydrodesulfurization, the octane of the coker naphtha drops to about 45 road octane. With Mo/beta, it is possible to recover the octane up to about 60 road octane (Table 5, FIG. 1). Unlike Mo/ZSM-5, Mo/beta shows high activity at low temperatures and at high temperatures the octane recovery is rather insensitive to temperature changes. Mo/beta has an advantage in higher gasoline volume yield compared to Mo/ZSM-5 (FIG. 2). The overall number of octane-barrels is higher with Mo/beta catalyst.

We claim:

1. A process of upgrading a sulfur-containing, thermally cracked, unsaturated coker naptha feed fraction boiling in the gasoline boiling range which comprises:

subjecting a residual feed in a coker to form a sulfur-containing coker naphtha feed fraction boiling in the gasoline boiling range within the range of $C_5$ to 330° F., and containing at least 1000 ppm sulfur, contacting the sulfur-containing feed fraction with a hydrodesulfurization catalyst in a first reaction zone, operating under a combination of elevated temperature, elevated pressure and an atmosphere comprising hydrogen at a temperature of about 600 to 750 F, a pressure of about 300 to 1000 psig, a space velocity of about 1 to 5 LHSV, and a hydrogen to hydrocarbon ratio of about 1000 to 3000 standard cubic feet of hydrogen per barrel of feed, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality which also includes molybdenum as a metal component having hydrogenation functionality at a temperature of about 600 to 850 F, a pressure of about 50 to 1500 psig, a space velocity of about 0.5 to 10 LHSV, and a hydrogen to hydrocarbon ratio of about 0 to 5000 standard cubic feet of hydrogen per barrel of feed to convert the gasoline boiling range portion to a product comprising a fraction boiling in the gasoline boiling range having a higher octane number than the gasoline boiling range fraction of the intermediate product.

2. The process as claimed in claim 1 in which the acidic catalyst comprises an intermediate pore size zeolite.

3. The process as claimed in claim 2 in which the intermediate pore size zeolite has the topology of ZSM-5.

4. The process as claimed in claim 3 in which the intermediate pore size zeolite is in the aluminosilicate form.

5. The process as claimed in claim 1 in which the second stage upgrading is carried out at a temperature of about 650° to 800° F., a pressure of about 300 to 1000 psig, a space velocity of about 1 to 3 LHSV, and a hydrogen to hydrocarbon ratio of about 100 to 3000 standard cubic feet of hydrogen per barrel of feed.

6. The process as claimed in claim 1 in which the coker naphtha is produced by the delayed coking of a residual petroleum fraction.

7. A process of upgrading a sulfur-containing coker naphtha feed fraction boiling in the range from $C_5$ to 400° F. which comprises:

hydrodesulfurizing the sulfur-containing coker naphtha feed having a sulfur content of at least 1000 ppmw, hydrodesulfurization catalyst in a hydrodesulfurization zone, operating under a combination of elevated temperature, elevated pressure and an atmosphere comprising hydrogen at a temperature of about 500° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed, to produce an intermediate product comprising a normally liquid fraction which has a reduced sulfur content compared to the feed;

contacting the gasoline boiling range portion of the intermediate product in a second reaction zone with a catalyst of acidic functionality comprising a molybdenum hydrogenation component and a zeolitic component at a temperature of about 600° to 850° F., a pressure of about 50 to 1500 psig, a space velocity of about 0.5 to 10 LHSV, and a hydrogen to hydrocarbon ratio of about 0 to 5000 standard cubic feet of hydrogen per barrel of feed, to convert it to a product comprising a fraction boiling in the gasoline boiling range having a higher octane number than the gasoline boiling range fraction of the intermediate product.

8. The process as claimed in claim 7 in which the zeolitic component comprises ZSM-5 in the aluminosilicate form.

9. The process as claimed in claim 7 in which the zeolitic component comprises zeolite beta in the aluminosilicate form.

10. The process as claimed in claim 7 in which the coker naphtha has a sulfur content from 1,000 to 10,000 ppmw and a Bromine Number from 30 to 100.

* * * * *